United States Patent [19]

Valentin

[11] Patent Number: 4,615,257

[45] Date of Patent: Oct. 7, 1986

[54] SWASHPLATE TYPE AXIAL-PISTON PUMP

[76] Inventor: Ingo Valentin, 15000 W. Cleveland Ave., New Berlin, Wis. 53151

[21] Appl. No.: 746,240

[22] Filed: Jun. 18, 1985

[30] Foreign Application Priority Data

Jun. 26, 1984 [DE] Fed. Rep. of Germany ..... 3423467

[51] Int. Cl.[4] ..... F01B 13/04

[52] U.S. Cl. ..... 91/499; 91/487; 91/505

[58] Field of Search ..... 91/484–487, 91/499, 504–506

[56] References Cited

U.S. PATENT DOCUMENTS

| | | | |
|---|---|---|---|
| 2,847,938 | 8/1958 | Gondek | 91/488 |
| 2,847,984 | 8/1958 | Gallant | 91/486 |
| 2,925,046 | 2/1960 | Budrich | 91/506 |
| 3,092,034 | 6/1963 | Bartholomaus | 91/499 |
| 3,124,079 | 3/1964 | Boyer | 91/505 |
| 3,256,782 | 6/1966 | Ebert | 91/505 |
| 3,747,476 | 7/1973 | Ankeny | 91/506 |
| 3,861,276 | 1/1975 | Lucien | 91/499 |

*Primary Examiner*—William L. Freeh

*Attorney, Agent, or Firm*—Philip P. Mann

[57] ABSTRACT

An axial-piston pump includes a rotatable cylinder barrel having pistons extending from cylinder bores formed at one end thereof. A swashplate is positioned adjacent the cylinder barrel and includes an inclined surface for engaging and reciprocating the pistons upon rotation of the cylinder barrel relative thereto. The cylinder barrel is rotatably supported by a bearing spaced from the swashplate in a direction toward the cylinder barrel. The location and orientation of the bearing results in the development of bearing forces which operate on the same equivalent force point as the contact forces developed between the pistons and swashplate. Since the forces thus developed all operate on the same equivalent force point, pitching or cocking moments on the cylinder barrel are substantially eliminated.

20 Claims, 4 Drawing Figures

SWASHPLATE TYPE AXIAL-PISTON PUMP

BACKGROUND AND SUMMARY OF THE INVENTION

This invention relates generally to swashplate type axial-piston hydraulic pumps, and in particular to an improved bearing arrangement for rotatably supporting the rotatable cylinder barrel in such a pump.

Swashplate type axial-piston hydraulic pumps are well known in the art and typically include a generally cylindrical cylinder barrel rotatably mounted within a pump housing. One or more pump cylinder bores, having pump pistons reciprocably mounted therein, are disposed around the rotational axis of the cylinder barrel in parallel, or almost parallel alignment therewith. The ends of the pistons project beyond the end of the cylinder barrel so as to engage the surface of an angled swashplate stationarily mounted adjacent the end of the cylinder barrel within the barrel housing. When the cylinder barrel is rotated within the housing, slipperpads, mounted to the piston ends, follow the surface of the angled swashplate with the result that the pistons are reciprocated within their respective cylinder bores. A fluid control valve assembly, disposed adjacent the end of the cylinder barrel furthest from the swashplate, controls the ingress and egress of hydraulic fluid from the piston cylinders such that a pumping effect is produced in response to rotation of the cylinder barrel within the pump housing.

Since the plane of the swashplate is inclined relative to the rotational axis of the cylinder barrel, the contact force between each piston head slipperpad and the swashplate includes a substantial, non-zero, radial component in addition to an axial component which actually drives the pistons. This radial component tends to cause cocking or pitching of the cylinder barrel within the pump housing. As proper operation of the pump depends on a very close fitting relationship between the inlet and outlet port of the cylinder barrel and the fluid control valve assembly, any pitching or cocking of the cylinder barrel affects the operation of the pump and may result in damage or excessive wear of the valve assembly.

The resultant sum of all the contact forces exerted on the cylinder barrel by each piston can be resolved into single equivalent axial and radial force components operating on a single equivalent force point located along the rotational axis of the cylinder barrel and displaced from the end thereof in a direction toward the swashplate. Preferably, the cylinder barrel is journaled within the pump housing such that the radial component of the resultant equivalent force is balanced by the bearing forces. When so journaled, cylinder barrel cocking and pitching can be reduced or eliminated.

One well known design which sought to balance the radial force on the cylinder barrel of a swashplate type hydraulic pump included an elongate extension collar on the exterior circumference of the cylinder barrel. The collar extended beyond the end of the barrel and was of sufficient length to encircle the equivalent force point located near the swashplate. A roller or sleeve bearing was located between the exterior of the extension collar and pump housing. Even though the equivalent force point was spaced away from the end of the actual end of the cylinder barrel, the extension collar nevertheless permitted the bearing to be located in a plane which was perpendicular to the rotational axis of the cylinder barrel and which intersected the equivalent force point. When so located, the bearing opposed the radial force component and pitching of the cylinder barrel was minimized. While this prior design was effective in reducing cylinder barrel pitching, the need for the cylinder barrel extension collar to encircle the actual equivalent force point required that the collar also encircle the swashplate and slipperpads of the piston heads supported therefrom. This increased the axial and radial dimensions of the pump and resulted in increased complexity, cost and internal operating friction.

The present invention is directed to an improved swashplate type axial-piston hydraulic pump wherein the rotating cylinder barrel of the pump is supported against the radial force components by a bearing spaced away from the equivalent force point in a direction along the cylinder barrel rotational axis such that little or no pitching moments are created a the cylinder barrel rotates. This is accomplished without the use of an extension collar and without the need for a bearing to encircle the swashplate and piston head slipperpads.

In accordance with one principal aspect of the invention, the bearing between the cylinder barrel and the pump housing is located between the ends of the cylinder barrel and, accordingly, is displaced substantially from the equivalent force point in a direction along the rotational axis of the cylinder barrel. While the plane of the bearing is axially displaced from the equivalent force point, the bearing is arranged such that all bearing forces which are developed perpendicularly to the bearing race define an acute angle relative to the rotational axis of the cylinder barrel and intersect the rotational axis in the general area of the equivalent force point. Thus, the location and orientation of the bearing is such that the support forces developed by the bearing generally define a cone around the cylinder barrel rotational axis. The base of the cone so defined is defined by the bearing race and the apex of the cone lies on the cylinder barrel rotational axis at the equivalent force point. The height of the cone is thus equal to the distance by which the bearing is displaced from the equivalent force point. This distance allows the effective support of the cylinder barrel to be moved axially away from the swashplate in the direction of the cylinder barrel so that the cylinder barrel bearing can be located in front of the swashplate and piston head slipperpads. Thus, the need for an extension collar is eliminated since the bearing can now be located directly on the cylinder barrel. This permits smaller radial and axial dimensions in the completed pum and further results in reduced cost and operating friction.

As the cylinder barrel rotates, there is a small cyclical change in the actual location of the equivalent force point along the cylinder barrel rotational axis. Accordingly, since the apex of the con formed by the resulting bearing force is stationary on the rotational axis, the equivalent force point on which the radial force acts, and the point on which the bearing forces act, will coincide exactly only momentarily. However, the distance over which the equivalent force point moves during rotation of the cylinder barrel is very small and the resultant pitching moment of the barrel is so small as to be negligible.

In order to support the cylinder barrel against the axial components of the contact force between the swashplate and the piston head slipperpads, the bearing also develops substantial axial force components in addition to the radial force components. The axial components are easily obtained since the bearing, in most practical applications, is located considerably in front of the equivalent force point. Thus, the inclined resultant of the bearing forces will generally include a substantial axial component.

In accordance with another principal aspect of the invention, the race of the bearing which rotatably supports the cylinder barrel is of sufficient width so that the resultant bearing forces do not converge to a point on the rotational axis of the cylinder barrel but rather define a line segment, equal in length to the width of the bearing race, along the rotational axis. Preferably, the width of the bearing race, and accordingly, the length of this line segment, is sufficiently great so that the equivalent force point of the swashplate contact forces remain located within the projection of the bearing race during the cyclical movement of the equivalent force point along the rotational axis.

In still another principal aspect of the present invention, the bearing is located directly between the outer circumference of the cylinder barrel and the sidewall of the pump housing. This results in a large angle between the bearing forces and the cylinder barrel rotational axis which is advantageous.

In still another principal aspect of the present invention, the pump housing includes a journal disposed coaxially with the rotational axis of the cylinder barrel. A bearing carried on the journal engages the cylinder barrel to support the cylinder barrel for rotation within the pump housing. In this arrangement, the bearing does not extend beyond the outer circumference of the cylinder barrel. Additionally, the journal can be located either on the side of the cylinder barrel nearest the swashplate, or, on the side of the cylinder barrel opposite the swashplate. In all cases, either hydrodynamic or hydrostatic slide or roller type bearings can be advantageously employed.

BRIEF DESCRIPTION OF THE DRAWINGS

The features of the present invention which are believed to be novel are set forth with particularity in the apended claims. The invention, together with the further objects and advantages thereof, can best be understood by reference to the following description taken in conjunction with the accompanying drawings, in the several figures of which like reference numerals identify like elements, and in which:

DESCRIPTION OF THE PREFERRED EMBODIMENT

Figures 1, 1A:
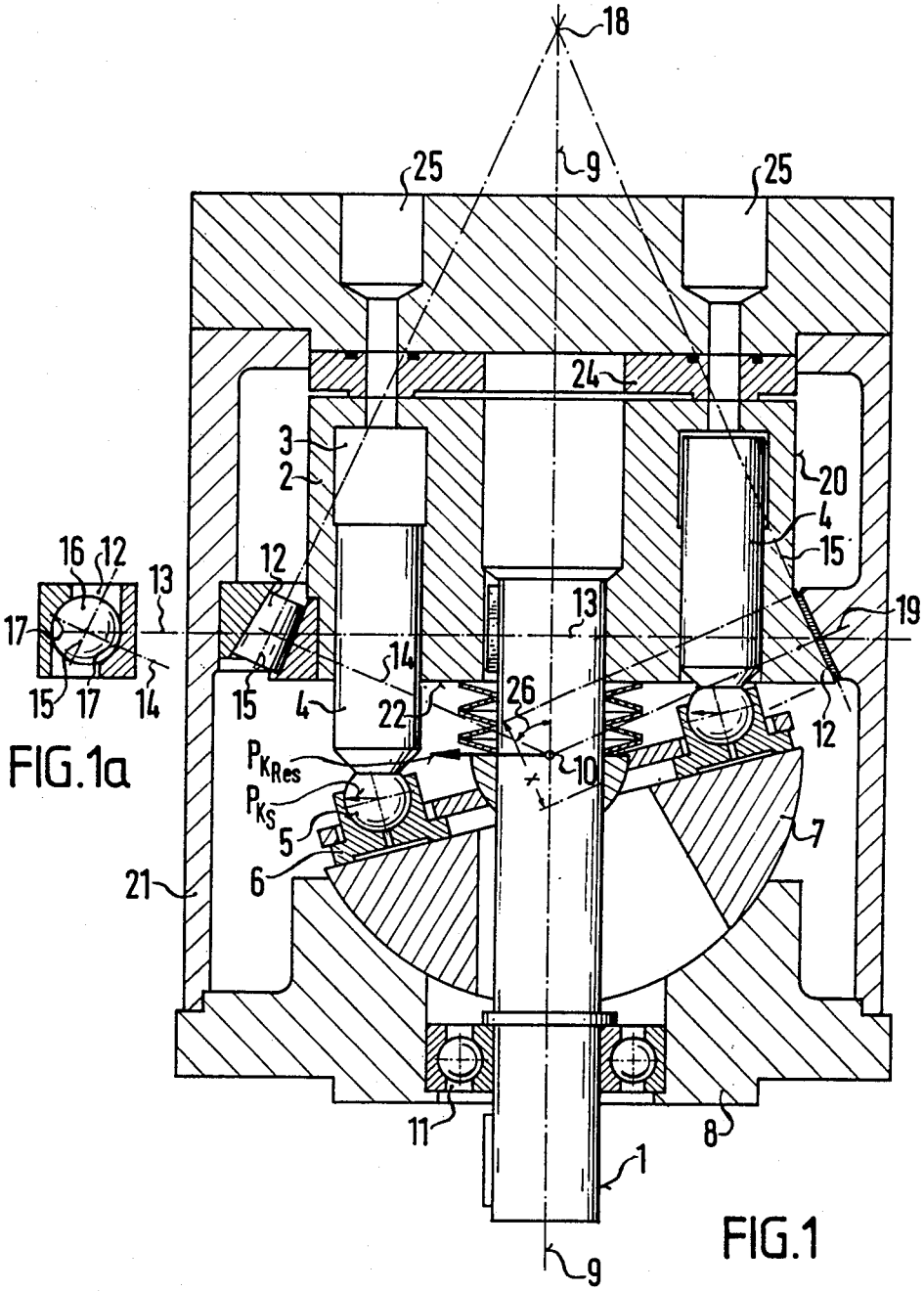
FIG. 1 is an axial sectional view of a swashplate type axial-piston hydraulic pump constructed in accordance with the invention.
FIG. 1*a* is an axial sectional view of an alternate cylinder barrel support bearing for use in the pump constructed in accordance with the present invention.

Referring to the figures and in particular to FIG. 1, a swashplate type axial-piston hydraulic pump is shown. As illustrated, the pump includes a cylinder barrel assembly having a generally cylindrical cylinder barrel 2 rotatably mounted within a generally cylindrical pump housing 21. The cylinder barrel 2 of the cylinder barrel assembly is connected to a rotatable drive shaft 1 which extends into the pump housing through an aperture formed in a pump housing end cap 8. The drive shaft 1 is journaled for rotation relative to the pump housing by means of a ball bearing assembly 11 and is coupled to the cylinder barrel 2 for co-rotation therewith. Drive shaft 1 can act as either an input or output shaft depending upon whether the machine is used as a hydraulic pump or motor.

The cylinder barrel assembly includes a plurality of individual pistons 4 which are received in respective circular cross-sectioned cylinder bores 3 formed in cylinder barrel 2. The pistons and cylinders are disposed around the rotational axis 9 of the drive shaft and cylinder barrel in generally parallel relationship thereto. Each of the pistons is slidably received in its respective cylinder bore for reciprocating movement along the direction of the cylinder barrel/drive shaft rotational axis 9.

Adjacent the end 22 of the cylinder barrel 2 through which the heads 5 of the pistons 4 extend, the pump is provided with a swashplate 7 having an upper surface facing the cylinder barrel. The swashplate encircles drive shaft 1 and remains stationary relative to the pump housing while the drive shaft rotates. In accordance with known techniques, the swashplate can be adjustably positioned such that the plane of its surface is inclined relative to the rotational axis 9 of the drive shaft 1 as illustrated. A plurality of slipperpads 6 are provided between each piston head 5 and the surface of the swashplate. The slipperpads and pistons are spring biased, or mechanically held, against the surface of the swashplate such that they remain in contact with the swashplate as the drive shaft and cylinder barrel 2 rotate within the pump housing. Such rotation results in each slipperpad following the surface of the swashplate with the effect that the pistons coupled thereto reciprocate within their respective cylinders as the cylinder barrel turns.

At its uppermost end, opposite end 22 nearest the swashplate, the cylinder barrel rests against a valve plate 24 which, in cooperation with inlet and outlet ports 25 formed in the pump housing, controls the flow of hydraulic fluid to and from the cylinders of the cylinder barrel. Thus, reciprocation of the pistons in response to rotation of the drive shaft results in pumping of the hydraulic fluid from the inlet to the outlet port.

Rotation of the drive shaft and cylinder barrel further results in the development of substantial contact forces between each of the slipperpads 6 and the inclined surface of the relatively stationary swashplate 7. The total contact force resulting between each slipperpad and the swashplate is developed in a direction perpendicular to the swashplate surface and, accordingly, can be resolved into both radially and axially directed components. The axial components, as transmitted to the pistons through the piston heads, provide the effective pumping forces which drive hydraulic fluid from the cylinder chambers with each revolution of the cylinder barrel. The radially directed component $Pk_{res}$ of the contact force is not effective in pumping the hydraulic fluid but rather develops a rotational moment around the rotational axis 9. The sum of the radial components also results in a net force on the cylinder barrel in a direction perpendicular to the rotational axis 9 which, if not provided for, can result in pitching or cocking of the cylinder barrel assembly within the pump housing.

The sum of the individual contact forces between the individual slipperpads and the swashplate surface can be thought of as a single equivalent effective force applied to a single equivalent force point 10 located along the rotational axis of the drive shaft/barrel cylinder combination. The equivalent force can be resolved into a single axial component operating in the direction of the drive shaft rotational axis and a single radially directed component $Pk_{res}$ operating in a direction toward the lowermost edge of the swashplate surface and perpendicular to the rotational axis 9. In order to avoid cocking or pitching of the cylinder barrel 2 in response to the radial component of the equivalent force, the pump, in accordance with the invention, includes a cylinder barrel support bearing 12 between the outer surface of the cylinder barrel and the interior surface of the pump housing 21.

As illustrated in FIG. 1, cylinder barrel support bearing 12 is located adjacent the end 22 of the cylinder barrel nearest the swashplate and is oriented in a plane 13 perpendicular to the rotational axis 9 of the drive shaft 1. Plane 13 is located between the ends of the cylinder barrel 2 and, accordingly, is located substantially beyond the equivalent force point 10 in a direction away from the swashplate 7.

In further accordance with the invention, the race 15 of bearing 12 is of generally conical form such that the projection of the race in a direction away from the swashplate forms a cone having an apex 18 intersecting the drive shaft rotational axis 9 at a point located toward the direction of the valve plate 24. The apex 18 and support bearing 12 are located such that the line of application 14 of the resulting bearing forces, which are located perpendicular to the bearing race 15, form an acute angle 26 with the rotational axis 9 and such that the line of application 14 intersects rotational axis 9 in the vicinity of the equivalent force point 10.

The bearing force developed along the line of application 14 thus includes both axially directed and radially directed forces. The axially directed bearing forces and the forces between the cylinder barrel and valve plate are sufficient to balance the axially directed component of the total contact force between the slipperpads and the swashplate surface, while the radially directed component of the bearing force balances the radially directed component $Pk_{res}$ of the contact force. The orientation and location of the bearing is such that the equivalent resultant of both the bearing forces and the slipperpad contact forces each operate on the same effective force point 10. Accordingly, the total pitching or cocking moment developed on the cylinder barrel 2 and drive shaft 1 is zero since the moment arm between the points of application of the contact and bearing forces is of zero length. By arranging the bearing in this manner, cylinder barrel pitching or cocking is reduced or eliminated without requiring the use of an extension collar on the cylinder barrel.

As further illustrated in FIG. 1, bearing 12 can be either a hydrodynamic or hydrostatic slide bearing as shown at the right hand side of the figure, or can be of the tapered roller type as illustrated at the left hand side of the figure. In the case of roller bearings, the rotational axis of each roller is directed toward the apex 18 as illustrated. Accordingly, the resultant of the bearing forces developed perpendicularly to the roller axis will operate on the equivalent force point 10.

FIG. 1*a* illustrates a ball bearing arrangement for providing the bearing forces required to minimize or eliminate cylinder barrel pitching. When a ball bearing assembly is utilized, the contact areas 17 between the row of balls 16 are positioned as illustrated such that a line through the contact areas 17 intersect the equivalent force point 10.

Since in practice the equivalent force point 10 will shift slightly along the rotational axis 9 as the drive shaft and cylinder barrel rotate, the bearing race 15 is preferably of sufficient width so that the equivalent force point 10 remains within the projection of the width of the bearing race onto the rotational axis 9. Thus, as illustrated in FIG. 1, dimension x which corresponds to the width of bearing race 15 as projected parallel to a normal 19 constructed perpendicular thereto is sufficient to assure that equivalent force point 10 remains within the projection of the bearing race at all times.

Figure 2:
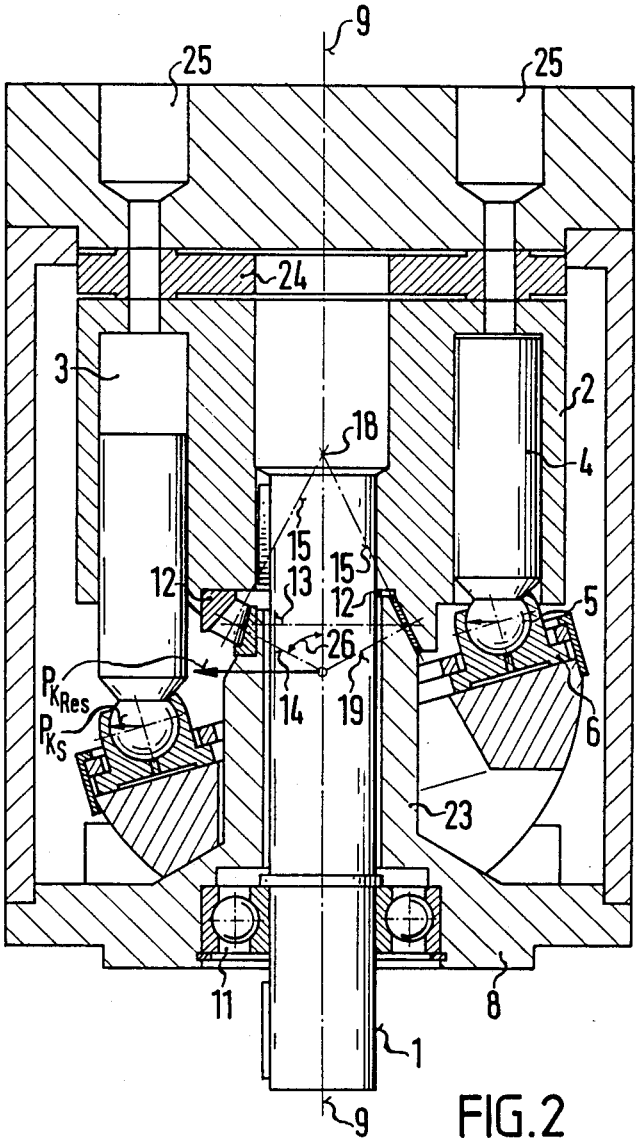
FIG. 2 is an axial sectional view of another embodiment of the pump constructed in accordance with the invention showing the cylinder barrel support bearing mounted on a journal located on the swashplate side of the cylinder barrel.

FIG. 2 illustrates an alternate embodiment of a swashplate type axial-piston hydraulic pump constructed in accordance with a principal aspect of the invention. In this embodiment, the cylinder barrel support bearing 12 is not located on the exterior of the cylinder barrel as in the embodiment of FIG. 1, but, rather, is within the area bounded by the pistons 4 disposed around axis 9. Bearing 12 is mounted on a generally cylindrical journal 23 extending upwardly from the interior surface of housing end cap 8 around drive shaft 1. Bearing 12 is located at the exterior of the end of journal 23 and rotatably supports cylinder barrel 2 for rotation within the pump housing. In accordance with the invention, the plane 13 of the bearing is axially displaced from the equivalent force point 10 while the normal 19 constructed perpendicular to the bearing race 15 extends therethrough. Again, the width of bearing race 15 is such that the projection of the bearing onto the rotational axis 9 encloses the equivalent force point. Accordingly, the bearing arrangement illustrated in FIG. 2 supports the cylinder barrel 2 for rotation in a manner which avoids pitching or cocking. Since the bearing does not extend beyond the outer circumference of the cylinder barrel 2, nor substantially beyond the undersurface thereof, effective support against the radial component of the total cylinder barrel contact force is provided without any substantial increase in the dimension of the swashplate pump.

Figure 3:
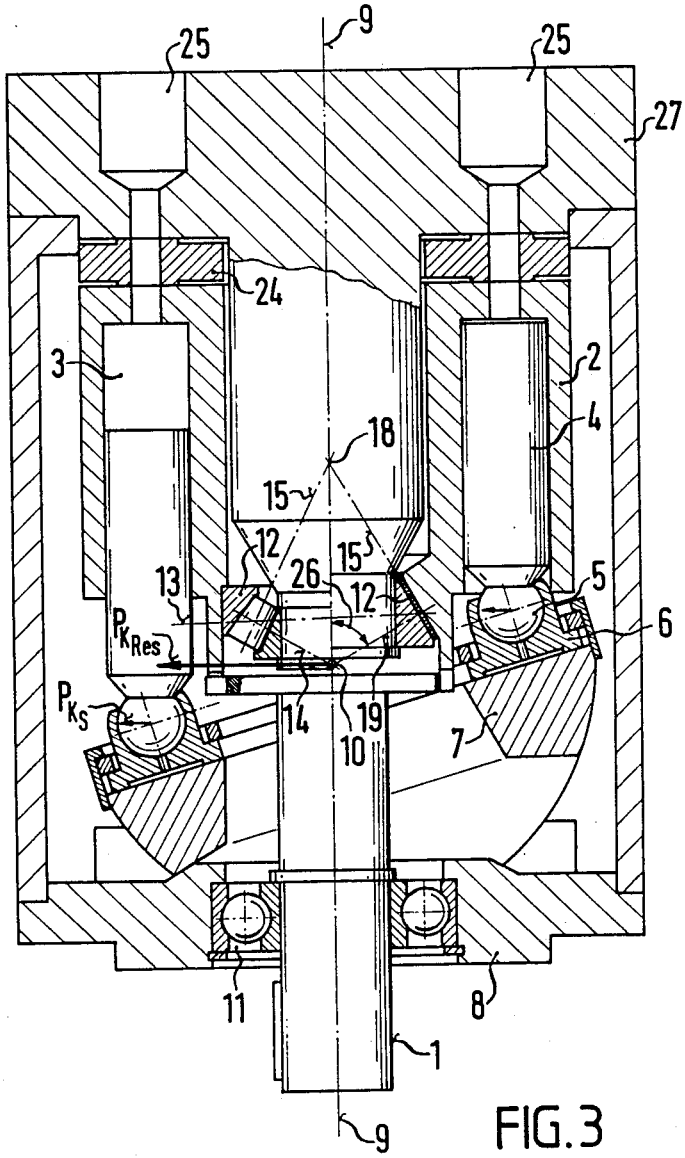
FIG. 3 is an axial sectional view, similar to FIG. 2, of another embodiment of the pump constructed in accordance with the invention, showing the cylinder barrel support bearing mounted on a journal located on the side of the cylinder barrel opposite the swashplate.

FIG. 3 is another embodiment of the swashplate axial-piston hydraulic pump constructed in accordance with the invention wherein the cylinder barrel 2 is supported by a bearing 12 mounted at the end of a generally cylindrical journal in coaxial alignment with the drive shaft 1. In this embodiment, the journal extends from a housing end cap 27 opposite housing end cap 8 and comprises a generally cylindrical pillar having a region of reduced diameter adjacent its end. Cylinder barrel 2 is provided with a generally circular recess around its central axis in which the journal is received. Opposite the journal, the end of the drive shaft 1 is connected through a generally horizontal disk to a circular flange portion extending from the lower surface of the cylinder barrel around the end of the journal. As illustrated, the cylinder barrel is generally sleeve-like in form and is dimensioned as to encircle the cylindrical journal projecting from the end cap 27 of the pump housing.

Between the end of the journal and the cylinder barrel 2, the pump in accordance with the invention, is provided with a cylinder barrel support bearing 12 having a diameter smaller than that of the cylinder barrel 2. Bearing 12 is mounted between a lip formed at the end of the journal and the cylinder barrel as illustrated. The plane 13 of the bearing is axially displaced from the equivalent force point 10 in a direction away from the swashplate while the bearing race 15 is oriented such that a normal 19 constructed perpendicular to its surface intersects the rotational axis 9 at or near the equivalent force point. Accordingly, the bearing effectively supports the cylinder barrel 2 against the radial component of the cylinder barrel contact force such that pitching or cocking moments are avoided. Since the diameter of bearing 12 is considerably less than that of the cylinder barrel 2, such effective balance is achieved without increasing the dimensions of the hydraulic pump.

In each of the embodiments illustrated in FIGS. 1, 2 and 3, the size, location and orientation of the bearing race 15 is such that the equivalent bearing force operates through the equivalent force point 10 at which the resultant of all the cylinder barrel/swashplate contact forces operate. Furthermore, the line of application of the total bearing force forms an acute angle 26 relative to the rotational axis 9 of the pump drive shaft 1. Preferably, the acute angle 26 between the bearing force and the rotational axis 9 in all cases is at least 60° in order to assure that adequate axial bearing force components are developed. It will be appreciated however that greater or lesser angles can be successfully utilized. In FIG. 1, the projection of the bearing race 15 forms an apex 18 which lies on the rotational axis of the drive shaft at a point spaced from plane 13 in a direction toward the end of the pump housing. In FIGS. 2 and 3, the bearing is of reduced diameter and the projection of the bearing races in these embodiments also form peaks 18 which lie on the rotational axis 9 of the pump drive shaft 1 but at a point 18 which is within the pump housing. In all cases, the orientation of the bearing race is such that the total bearing force includes a substantial axial component in addition to the radial component.

The present invention thus results in a swashplate type axial-piston hydraulic pump wherein force moments, which may tend to cause pitching or cocking of the pump cylinder barrel, are reduced or eliminated. This is accomplished without the need to increase the external dimension of the pump housing to any appreciable degree and further results in a relatively simple, yet functional, construction. While the invention has been described in conjunction with various roller, slide or ball bearing elements, it will appreciated that other bearing types can be successfully utilized. Additionally, such bearings can be of either hydrodynamic or hydrostatic types.

While a particular embodiment of the invention has been shown and described, it will obvious to those skilled in the art that changes and modifications may be made without departing from the invention in its broader aspects, and, therefore, the aim in the apended claims is to cover all such changes and modifications as fall within the true spirit and scope of the present invention.

I claim:

1. An axial-piston pump comprising:

a cylinder barrel assembly having a cylinder barrel and a piston received in a cylinder bore in said cylinder barrel;

a swashplate having an inclined surface engaging said cylinder barrel assembly for exerting an equivalent force on an equivalent force point located between said inclined surface and said cylinder barrel in response to rotation if said cylinder barrel assembly relative to said swashplate, said equivalent force including an axial component for reciprocating said piston in said cylinder bore and a radial component oriented substantially perpendicularly to said axial component, and means spaced from said equivalent force point in a direction toward said cylinder barrel for supporting said cylinder barrel assembly for rotation relative to said swashplate and for developing on said equivalent force point a bearing force having a radial bearing force component substantially equal in magnitude and opposite in direction to said radial equivalent force component such that the net resultant sum of said radial equivalent and radial bearing force components is substantially zero.

2. An axial-piston pump as defined in claim 1, wherein said swashplate is relatively stationary and said cylinder barrel assembly rotates around a rotational axis extending through said swashplate, and wherein said means includes a bearing coupled to said cylinder barrel and defining a plane oriented generally perpendicularly to said rotational axis

3. An axial-piston pump as defined in claim 2, wherein said equivalent force point lies on said rotational axis and said plane intersects said rotational axis at a point substantially displaced from said equivalent force point in a direction toward said cylinder barrel.

4. An axial-piston pump as defined in claim 3, wherein said bearing includes a bearing race defining a generally conical ring area, and wherein said ring area coverages toward a conical apex located substantially on said rotational axis such that the perpendicular inward projection of said conical ring area intersects said rotational axis substantially at said equivalent force point.

5. An axial-piston pump as defined in claim 4, wherein the width of said bearing race is such that the projection of said race onto to said rotational axis in the direction perpendicular to said race includes said equivalent force point and extends in both directions beyond said equivalent force point.

6. An axial-piston pump as defined in claim 5, wherein said bearing engages the outer circumference of said cylinder barrel.

7. An axial-piston pump as defined in claim 5, wherein said bearing is mounted between said cylinder barrel and a journal extending through said swashplate in a direction toward said cylinder barrel.

8. An axial-piston pump as defined in claim 5, wherein said bearing is mounted between said cylinder barrel and a journal extending through an aperture in said cylinder barrel in a direction along the rotational axis of said cylinder barrel.

9. An axial-piston pump as defined in claim 7, wherein said bearing is of lesser diameter than said cylinder barrel.

10. An axial-piston pump as defined in claim 8, wherein said bearing is of lesser diameter than said cylinder barrel.

11. An axial-piston pump as defined in claim 9, wherein said bearing is a slide bearing.

12. An axial-piston pump as defined in claim 9, wherein said bearing is a roller bearing.

13. An axial-piston pump as defined in claim 10, wherein said bearing is a slide bearing.

14. An axial-piston pump as defined in claim 10, wherein said bearing is a roller bearing.

15. An axial-piston hydraulic pump comprising:

a cylinder barrel assembly including a cylinder barrel defining a central rotational axis and a plurality of pistons received in respective cylinder bores formed in said cylinder barrel around said rotational axis in parallel alignment therewith;

a swashplate mounted adjacent one end of said cylinder barrel assembly having a surface engaging said cylinder barrel assembly and intersecting said rotational axis at a non-perpendicular angle relative thereto for reciprocating said piston within said cylinder bores upon rotation of said cylinder barrel assembly relative to said swashplate, said cylinder barrel assembly and said surface developing an equivalent contact force therebetween having axial and radial components operating on a single equivalent force point on said rotational axis, said equivalent force point being spaced from said cylinder barrel in a direction toward said swashplate; and means engaging said cylinder barrel for supporting said cylinder barrel assembly for rotation relative to said swashplate, said means including a bearing defining a plane perpendicular to said rotational axis and intersecting said rotational axis at a point spaced from said equivalent force point in a direction toward said cylinder barrel and having a barrel race oriented such that the total bearing force developed by said bearing intersects said rotational axis substantially at said equivalent force point, whereby the total moment on said cylinder barrel resulting from the radial component of said total bearing force and said radial component of said equivalent contact force is substantially zero.

16. An axial-piston pump as defined in claim 15, wherein said bearing includes a bearing race having the general form of a conical ring area, said ring area converging toward a conical apex on said rotational axis such that the projection of said conical ring area in the direction perpendicular to the surface thereof intersects said rotational axis substantially at said equivalent force point.

17. An axial-piston pump as defined in claim 16, wherein the width of said bearing race is such that the projection of said race onto to said rotational axis in the direction perpendicular to said race includes said equivalent force point and extends in both directions beyond said equivalent force point.

18. An axial-piston pump as defined in claim 17, wherein said bearing engages the outer circumference of said cylinder barrel.

19. An axial-piston pump as defined in claim 17, wherein said bearing is mounted between said cylinder barrel and a journal extending through said swashplate in a direction toward said cylinder barrel.

20. An axial-piston pump as defined in claim 17, wherein said bearing is mounted between said cylinder barrel and a journal extending through an aperture in said cylinder barrel in a direction along the rotational axis of said cylinder barrel.

* * * * *

UNITED STATES PATENT AND TRADEMARK OFFICE

CERTIFICATE OF CORRECTION

PATENT NO. : 4,615,257

DATED : Oct. 7, 1986

INVENTOR(S) : Valentin

It is certified that error appears in the above-identified patent and that said Letters Patent is hereby corrected as shown below:

Column 2, line 18, the word "a" should read --as--.

Column 2, line 50, the word "pum" should read --pump--.

Column 2, line 55, the word "con" should read --cone--.

Claim 1, column 8, line 8, the word "if" should read --of--.

Signed and Sealed this

Twenty-fourth Day of February, 1987

*Attest:*

DONALD J. QUIGG

*Attesting Officer* *Commissioner of Patents and Trademarks*